US005230184A

United States Patent [19]

Bukhman

[11] Patent Number: 5,230,184

[45] Date of Patent: Jul. 27, 1993

[54] DISTRIBUTED POLISHING HEAD

[75] Inventor: Yefim Bukhman, Scottsdale, Ariz.

[73] Assignee: Motorola, Inc., Schaumburg, Ill.

[21] Appl. No.: 726,420

[22] Filed: Jul. 5, 1991

[51] Int. Cl.[5] ..... B24B 7/22; B24B 7/04

[52] U.S. Cl. ..... 51/283 R; 51/131.3; 51/373; 51/394

[58] Field of Search ..... 51/109 R, 129, 131.1, 51/131.3, 131.4, 281 SF, 283 R, 328, 373, 204, 209 R, 141, 151, 152, 154, 395, 206 P, 206.4, 395, 397, 398, 401, 237 M

[56] References Cited

U.S. PATENT DOCUMENTS

| | | | |
|---|---|---|---|
| 3,579,922 | 5/1971 | Mandonas | 51/283 R |
| 3,740,900 | 6/1973 | Youmans et al. | 51/235 |
| 3,905,162 | 9/1975 | Lawrence et al. | 51/281 SF |
| 4,606,151 | 8/1986 | Heynacher | 51/283 R |
| 4,663,890 | 5/1987 | Brandt | 51/283 R |
| 4,693,036 | 9/1987 | Mori | 51/131.3 |
| 4,726,150 | 2/1988 | Nishio et al. | 51/237 M |
| 4,850,152 | 7/1989 | Heynacher et al. | 51/62 |
| 4,897,966 | 2/1990 | Takahashi | 51/131.5 |
| 4,918,869 | 4/1990 | Kitta | 51/131.1 |
| 5,081,796 | 1/1992 | Schultz | 51/281 SF |
| 5,113,622 | 5/1992 | Nishiguchi et al. | 51/131.1 |

FOREIGN PATENT DOCUMENTS

| | | | |
|---|---|---|---|
| 0744009 | 7/1970 | Belgium | 51/394 |
| 0272362 | 6/1988 | European Pat. Off. . | |
| 0020494 | 2/1979 | Japan | 51/401 |
| 0011754 | 1/1989 | Japan . | |
| 3-121773 | 5/1991 | Japan | 51/281 SF |

*Primary Examiner*—Bruce M. Kisliuk
*Assistant Examiner*—Bryan Reichenbach
*Attorney, Agent, or Firm*—Joe E. Barbee

[57] ABSTRACT

A distributed polishing head assembly (17) has a flexible membrane (14), and a plurality of periodic polishing pads (12) that are attached to the flexible membrane (14). The polishing pads (12) are made from a flat semiconductor wafer that has been sawed into small pieces. The polishing head is rubbed against a semiconductor wafer (10) in order to planarize the wafer (10).

15 Claims, 2 Drawing Sheets

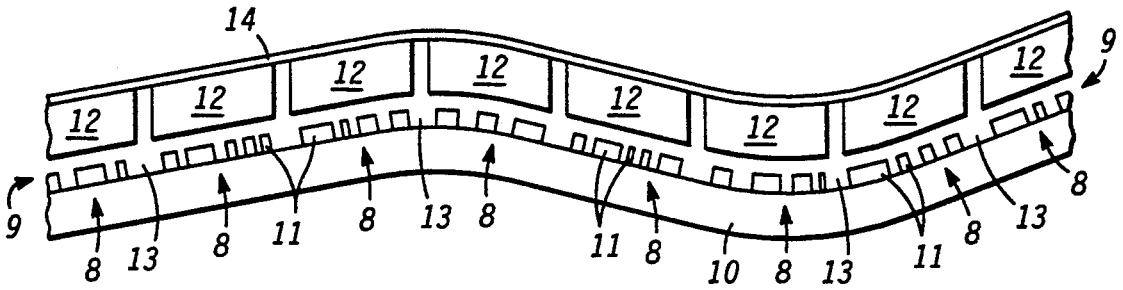
FIG. 1
FIG. 2
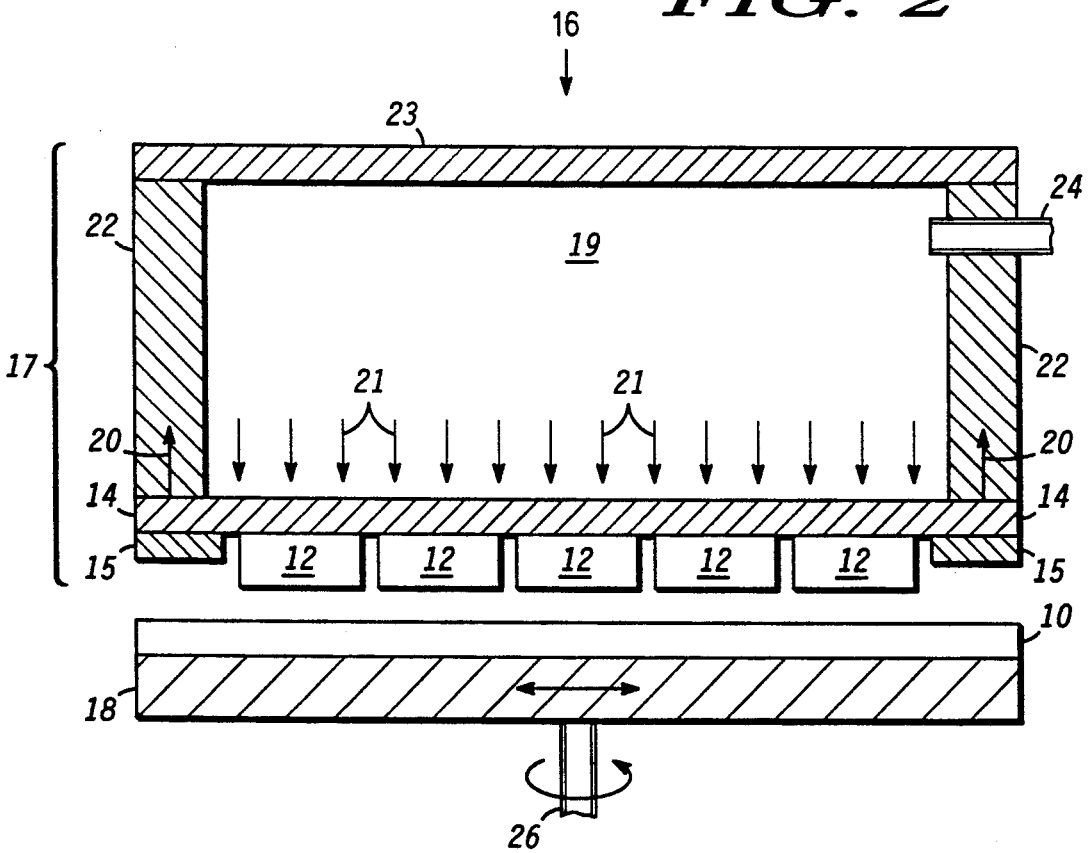

DISTRIBUTED POLISHING HEAD

BACKGROUND OF THE INVENTION

This invention relates, in general, to semiconductor products, and more particularly, to making semiconductor devices.

Generally, most very large scaled integrated (VLSI) semiconductor circuits are manufactured by depositing and patterning conductive and nonconductive materials or layers and by stacking the layers on top of each other. Patterning or creating features on or in a layer and then subsequently covering these features with an additional layer creates a nonplanar topography. As devices become more sophisticated and more complex, the number of layers stacked on each other tends to increase, and as the number of layers increases, planarity problems generally occur. Planarizing the stacked layers is a major problem, as well as a major expense in manufacturing semiconductor integrated circuits.

Generally, planarity problems are divided into two broad groups: local planarity, which is the planarity or the flatness of closely spaced features on a substrate and global planarity, which is planarity or flatness of all features over the substrate, regardless of their spacing and location. As the number of layers and the number of features increase, it is required that global planarity be achieved so that more features and more layers can be used. Planarization of features typically is attempted by several basic methods or approaches, such as using polymer planarization techniques with etching, using photolithography techniques with etching, combining both previously mentioned techniques, and chemical-mechanical polishing; none of which achieves global planarity.

Chemical-mechanical polishing has recently been used to planarize features. Successful use of chemical-mechanical polishing to planarize features would be a great benefit because of its relatively inexpensive cost compared to the previously discussed methods. Typically, the chemical-mechanical polishing method uses a pad and rubs the features that have to be planarized against the pad. Generally, a slurry is added while a rubbing action is taking place. The rubbing action of the features and the pad with the slurry creates a chemical-mechanical environment which removes or planarizes the features. However, several problems are evident with using chemical-mechanical polishing, such as inconsistency of removal rates across the substrate, variation of equipment parameters, and removal rates dependent on pattern density or location.

It can be seen that the conventional methods of planarizing and modifying features or topographies do not achieve global planarity, as well as being expensive and requiring additional processing steps. Each additional processing step and use of expensive equipment incur cost to a finished product. Additionally, each process step induces defects in the product. Therefore, a method and apparatus that would globally planarize features and substantially reduce the cost of building a product is highly desirable.

SUMMARY OF THE INVENTION

Briefly stated, a distributed polishing head is described that is comprised of a flexible membrane and a plurality of periodic polishing pads that are attached to the flexible membrane. A method of using the polishing head to polish semiconductor wafers is also disclosed.

BRIEF DESCRIPTION OF THE DRAWINGS

FIG. 1 is a cross-sectional illustration of a substrate with features and a polishing head in accordance with the present invention;

FIG. 2 is cross-sectional pictorial illustration of a distributed polishing head assembly.

DETAILED DESCRIPTION OF THE DRAWINGS

Figure 3:
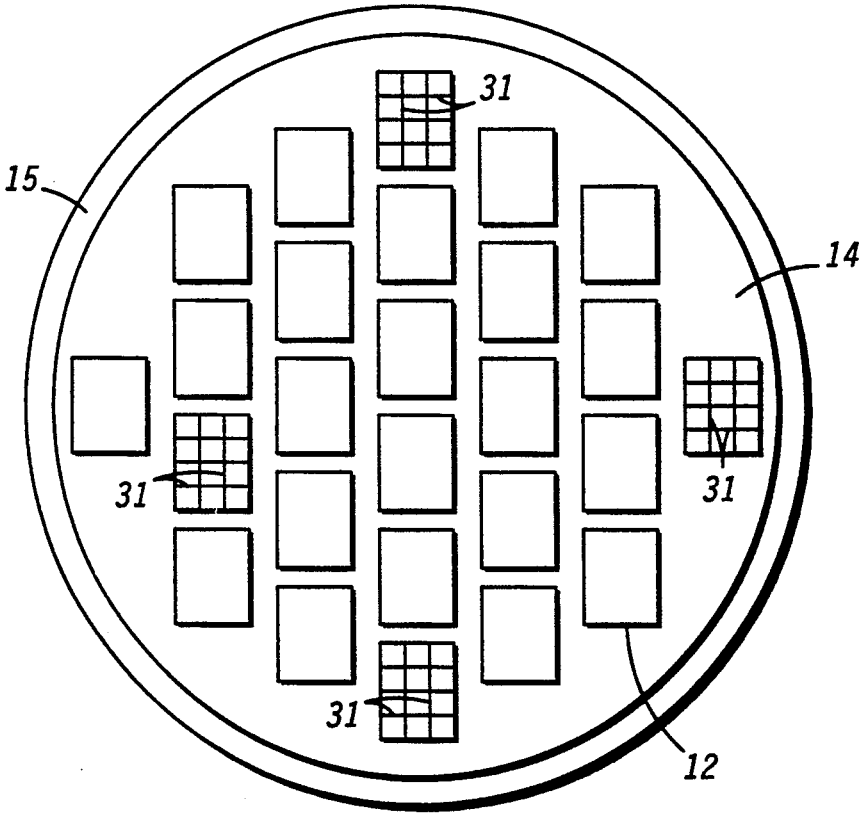
FIG. 3 is an illustration of a plan bottom view of the distributed polishing head.

FIG. 1 is a cross-sectional pictorial illustration of a substrate 10 with features 11 that need to be planarized and a multitude of polishing heads 12. Typically, substrate 10 is a semiconductor wafer, such as silicon or gallium arsenide that is being processed to build a plurality of VLSI circuits or a plurality VLSI dies 9. It should be understood that it is common to have the plurality of VLSI circuits 9 on one semiconductor substrate 10 and that the plurality of circuits 9 are separated by scribe grids 13. Scribe grids 13 into an individual VLSI circuit or an individual VLSI die 8 are areas between the individual VLSI die 8 that are devoid of circuitry. Substrate 10 is shown as a nonplanar substrate that is exaggerated for illustration purposes only. Substrate 10 generally is warped and bowed because of previous processing steps, such as heat treatments and depositions, thereby providing a nonplanar irregular surface with features 11 that need to be planarized.

Conventional chemical-mechanical polishing has been achieved by using a large soft polishing pad on a rotating disk. The features that need to be planarized on a substrate have been pressed into the soft pad. Generally, an abrasive ph balanced slurry solution has been used to provide a chemical component, while rubbing of the features and the pad provides a mechanical environment to promote removal of the features. However, use of the conventional large soft pad has had several problems. First, the features on the substrate are irregularly spaced with some features being closely spaced and having a higher density, while other features are spaced farther apart and have a lower density. When the soft polishing pad and the features have been pressed together, the soft polishing pad conforms to the features on the substrate and rubs all surfaces, i.e. top and sides of the features, as well as between the features simultaneously, thereby causing a smoothing and a rounding effect, but not globally planarizing the features. Additionally, in some high density feature areas, the pad is not able to penetrate between the features, and a general smoothing of topography and a partial planarization of the high density feature areas result; however, global planarization of the feature areas do not result.

In the present invention, a multitude of flat polishing pads 12 is pressed onto features 11. Polishing pads 12 are held by a flexible membrane 14, thereby allowing polishing pads 12 to conform to the exaggerated unevenness and irregular shape of substrate 10. Additionally, polishing pads 12 are flat so that when pressed onto features 11 only a top surface is contacted. Polishing pads 12 are larger than scribe grid 13 and usually sized on an order of the individual VLSI die 8, thus preventing polishing pads 12 from falling or tilting off of the individual VLSI die 8 with which polishing pad 12 is in contact during movement or vibration. In the present invention, contact of flat polishing pads 12 with features 11 allows for a conformal even pressure to be applied to top surfaces of features 11, thereby producing global planarization across the individual VLSI die 8, regardless of feature density, location, and size.

FIG. 2 is a cross-sectional pictorial illustration of one embodiment of a distributed polishing head assembly 16. Distributed polishing head assembly 16 is divided into two parts, a distributed polishing head 17 and a chuck 18. Substrate 10, for the sake of simplicity, does not show features 11 that are shown in FIG. 1 nor is the unevenness of substrate 10 illustrated.

Distributed polishing head 17 is further divided into two general parts: sidewalls 22 with top 23 and flexible membrane 14 with polishing pads 12. Edge ring 15 is used to support flexible membrane 14 which typically is made of an organic material. Distributed polishing head 17 is made in such a manner that a force or pressure 21 is uniformly applied across membrane 14, thereby allowing polishing heads 12 to conform to the unevenness and irregularities of substrate 10, when polishing pads 12 and substrate 10 are in contact with each other. Distributed polishing head 17 is made so that cavity 19 is formed. Generally, sidewalls 22 and top 23 are made from a single piece of metal, such as aluminium or stainless steel; however, pieces can be fabricated separately and then joined together. Overall shape of sidewalls 22 and top 23 can vary, such as round, oval, or rectangular. Additionally, sidewalls 22 can be made so that a means is available to hold and to release membrane 14 from sidewalls 22. In a preferred embodiment a vacuum source is used to hold edges of membrane 14, against sidewalls 22. By applying a vacuum to the edges of membrane 14, membrane 14 is securely held against sidewalls 22; however, by removing the vacuum and/or applying a slight positive pressure, removal and replacement of membrane 14 with polishing pads 12 is easily accomplished. Also, by holding membrane 14 at the edges, allows central portions of membrane 14 to be flexible. Holding means allows for quick replacement of polishing pads 12, when replacement of polishing pads 12 is necessary.

Port 24 allows for entrance of either a hydraulic pressure or a pneumatic pressure to enter cavity 19. The hydraulic pressure or pneumatic pressure is consequently applied to sidewalls 22, top 23, and flexible membrane 14. Application of physical laws of gases or liquids states that an equal pressure is applied to all surfaces of cavity 19. However, flexible membrane moves or bends in response to the pressure in chamber 19. This pressure is illustrated by arrows 21. It should be understood that the holding means that retains flexible membrane 14 against sidewalls 22 must have a force at least equal to pressure 21. If not, flexible membrane 14 is pushed off sidewalls 22. It should be further understood that port 24 location is not important to the present invention and that there are many locations and means available to allow gasses or liquids to enter and leave cavity 19.

Chuck 18 is made of a flat rigid material, such as stainless steel, so that it supports substrate 10. Substrate 10, typically, is held on chuck 18 by a vacuum force that is commonly used and well understood in the semiconductor art and is not important for understanding of the present invention. Chuck 18 is attached to a shaft or a movement means 26 that allows movement of chuck 18 in a vertical direction, a horizontal direction, rotational, and vibrational. It should be understood that when substrate 10 is held by chuck 18 that movement of chuck 18 is transferred to substrate 10. Additionally, any combination of movement can be done simultaneously, such as vibrational movement while chuck 18 slowly rotates.

A polishing process begins with substrate 10 on chuck 18. Chuck 18 holds substrate 10 typically by use of a vacuum source. A liquid can be applied to a top surface of substrate 10, such as a solvent or a slurry. Dispensing methods are well known and are not necessary for the understanding of the present invention. Additionally, use of specific liquids, such as solvents or slurries, is dependent upon specific application and materials involved. Also, it should be understood that depending upon the specific materials it is possible that no liquid need be used.

Chuck 18 with substrate 10 is moved so that contact is made between substrate 10 and periodic polishing pads 12. Pressure is allowed to enter cavity 19 through port 24, thereby creating a pressure 21 that pushes flexible membrane 14 in a downward or outward direction. As a result of flexible membrane 14 being pressed in a downward direction, polishing pads 12 are pressed downward and conform to the unevenness and irregularities of substrate 10. Additionally, having polishing pads 12 approximately the same size as the die and having each polishing pad positioned over a single die located on substrate 10 allows for polishing or planarization of each die individually, regardless of how warped or uneven the substrate 10 may be. Additionally, because membrane 14 pushes polishing pads 12 onto substrate 10 with an equal force or pressure, polishing rates for each individual polishing pad are relatively equal even on an irregular surface. Also, since polishing pads are flat and only contact the top surface of features 11 shown in FIG. 1, true global planarization is achieved.

Typically, a vibrational movement is in a sideways direction and is used to rub substrate 10 against polishing pads 12; however, other movement patterns can be used, such as circular or the like. Vibrational movement or vibrational frequency generally is in a range from hertz to kilohertz. Selection of vibrational frequency is dependent on specific application and specific materials. Also, substrate 10 can be rotated while the vibration movement is in progress. Rotation of substrate 10 while vibrational motion is taking place causes an averaging effect of removal rates from die to die. Global planarization of substrate 10 is achieved without additional processing steps or use of expensive equipment, such as photolithography equipment and RIE equipment, ultimately reducing the cost of manufacturing a product. Additionally, in another embodiment of the present invention, distributed polishing head assembly 16 is used in an automated machine that incorporates movement of semiconductor substrate 10 through several modular processes, such as cleaning, polishing, and measurement. It should be understood that many different modular processes, such as additional cleaning, measurement, and inspection could be intermixed in the automated machine.

FIG. 3 is a plan bottom view of flexible membrane 14, polishing pads 12, and edge ring 15. It should be understood that making polishing pads 12 and membrane 14 can be achieved by several different processes and material selections. In a preferred embodiment, edge ring 15 is provided with flexible membrane 14 stretched over edge ring 15. Edge ring 15 provides support for flexible membrane 14. In this embodiment of the present invention, a flat silicon wafer is attached or affixed by a strong adhesive to flexible membrane 14. The flat silicon wafer is subsequently sawn into predetermined coordinates that generally correspond to scribe grids 13 on semiconductor wafer 10, as shown in FIG. 1, that is to be polished, thereby forming polishing pads 12. Additionally, the adhesive that attaches the flat silicon wafer to the flexible membrane is substantially nonreactive with the slurries and solvents, if slurries or solvents are used to polish. Additionally, polishing pads 12 can be formed with several different coatings such as diamond, nitride, or the like. By selecting coating materials for pads 12 material characteristics, such as hardness can be selected, thereby affecting the removal rate of feature 11 in FIG. 1. Deposition of coatings are well known in the semiconductor art. Also, polishing pads 12 can be made so that grooves 31 are etched into the polishing pads 12 to facilitate input and output of polishing liquids. Patterning and etching of grooves 31 in polishing pads 12 is achieved by well-known photolithography and etching method used in the semiconductor art.

By now, it should be appreciated that there has been provided a novel apparatus and method for globally planarizing features on a substrate. It should also be appreciated that this approach greatly reduces cost and reduces the number of processing steps because of simplification of the planarizing process.

I claim:

1. A distributed polishing head comprising:

a flexible membrane;

a plurality of flat polishing pads that are attached to the flexible membrane; and a pressurized cavity, wherein the flexible membrane attaches and detaches from the pressurized cavity by applying a negative and a positive pressure, respectively, at peripheral edges of the flexible membrane, and wherein the flexible membrane extends across the pressurized cavity with the polishing pads facing away from the cavity.

2. The distributed polishing head of claim 1 wherein the plurality of polishing pads are comprised of silicon.

3. The distributed polishing head of claim 1 wherein the plurality of polishing pads are coated with a selected material having a characteristic hardness.

4. A distributed polishing head comprising:

an edge ring;

a flexible membrane, wherein the flexible membrane stretches across the edge ring, thus supplying support to the flexible membrane along peripheral edges where the flexible membrane and the edge ring meet;

a plurality of flat silicon polishing pads, each sized approximately to an individual VLSI die that is to be polished and, wherein the plurality of silicon pads are attached to the flexible membrane; and a means to distribute equal pressure across the flexible membrane, thereby distributing the equal pressure to each of the plurality of flat silicon polishing pads attached on the flexible membrane, wherein the flexible membrane attaches and detaches from the means to distribute equal pressure by applying a negative and a positive pressure, respectively, at peripheral edges of the flexible membrane.

5. The distributed polishing head of claim 4 wherein the flexible membrane is an organic membrane.

6. The distributed polishing head of claim 4 further comprising having the flat polishing pads coated with a material that is selected from the group comprising diamond or nitride.

7. A distributed polishing head assembly for planarizing a semiconductor substrate comprising:

an edge ring;

a flexible membrane;

a multitude of silicon flat polishing pads made from a flat silicon wafer that are attached to the flexible membrane;

a means to deliver equal pressure to each individual silicon flat polishing pad across the flexible membrane;

a substrate chuck having a semiconductor substrate with a multitude of VLSI dies placed and held on the substrate chuck, whereby the multitude of VLSI dies and the multitude of silicon flat polishing pads are pressed together so that the multitude of VLSI dies and the multitude of flat polishing pads are in contact; and a means for providing motion to the substrate that is held on the substrate chuck against the multitude of silicon flat polishing pads.

8. A distributed polishing head assembly of claim 7 wherein the motion is vertical.

9. A distributed polishing head assembly of claim 7 wherein the motion is horizontal.

10. A distributed polishing head assembly of claim 7 wherein the motion is rotational.

11. A distributed polishing head assembly of claim 7 wherein the motion is vibrational.

12. A distributed polishing head assembly for planarizing a semiconductor substrate comprising:

a flexible membrane;

a multitude of silicon polishing pads made from a flat silicon wafer that are attached to the flexible membrane;

a means to deliver equal pressure to each individual polishing pad across the flexible membrane;

a substrate chuck having a semiconductor substrate with a multitude of dies placed and held on the substrate chuck, whereby the multitude of dies and the multitude of polishing pads are pressed together so that the multitude of dies contacts the multitude of polishing pads; and a means for providing motion to the substrate that is held on the substrate chuck against the multitude of silicon polishing pads, wherein the individual silicon polishing pad is grooved.

13. A method for planarizing a semiconductor substrate comprising:

providing a semiconductor substrate having a plurality of VLSI dies that are delineated by scribe grids, the plurality of VLSI dies further including features on each of the plurality of VLSI dies;

providing a distributed polishing head with a plurality of flat polishing pads in which each of the plurality of flat polishing pads are sized on approximately each of the plurality of VLSI dies;

pressing the plurality of VLSI dies and the plurality of flat polishing pads together in such a manner that features associated with an individual VLSI dies are in contact with an individual flat polishing pad, thereby providing individual polishing pads for each individual VLSI dies; and rubbing features associated with the individual VLSI dies and the individual flat polishing pad together, thereby planarizing features on the individual VLSI dies.

14. The method of claim 13 further comprising rubbing the substrate and plurality of polishing pads together by a vibrational means.

15. A method for globally planarizing a semiconductor wafer comprising:

providing a semiconductor wafer with a surface having a plurality of dies that are delineated by scribe grids, the plurality of dies further including features on each of the plurality of dies, the surface of the semiconductor wafer being non-planar, thus making the plurality of dies on the surface of the semiconductor wafer non-planar;

providing a vacuum chuck and placing the semiconductor wafer on the vacuum chuck;

providing a distributed polishing head with a plurality of flat polishing pads in which each of the plurality of flat polishing pads are sized approximately to each of the plurality of dies;

pressing the plurality of dies on the semiconductor wafer and the plurality of flat polishing pads of the distributed polishing head together, so that features associated with an individual die are in contact with an individual flat polishing pad which allows each individual flat polishing pad to conform to a top surface of features on each individual die in which the semiconductor wafer is non-planar; and rubbing the plurality of polishing pads and the semiconductor wafer together that are conformed to the top surface of features on each individual die, thereby planarizing each individual die on the non-planar surface of the semiconductor wafer to produce global planarization across the semiconductor wafer.

* * * * *